United States Patent [19]

Da Costa

[11] Patent Number: 4,978,285

[45] Date of Patent: Dec. 18, 1990

[54] REED VALVE FOR HERMETIC COMPRESSOR

[75] Inventor: Caio Mario F. N. Da Costa, Joinville, Brazil

[73] Assignee: Empresa Brasileira de Compressores S.A., Joinville, Brazil

[21] Appl. No.: 486,556

[22] Filed: Feb. 27, 1990

[30] Foreign Application Priority Data

Mar. 16, 1989 [BR] Brazil ..... 8901306[U]

[51] Int. Cl.[5] ..... F04B 21/02

[52] U.S. Cl. ..... 417/569; 137/856

[58] Field of Search ..... 137/855, 856, 521; 417/559, 565, 569, 570

[56] References Cited

U.S. PATENT DOCUMENTS

| | | | |
|---|---|---|---|
| 1,029,726 | 6/1912 | Sprado | 137/856 X |
| 2,563,200 | 8/1951 | Veuning | 137/855 X |
| 4,325,680 | 4/1982 | Bar | 417/569 |
| 4,642,037 | 2/1987 | Frichtmann | 137/856 X |

FOREIGN PATENT DOCUMENTS

| | | | |
|---|---|---|---|
| 34078 | 2/1984 | Japan | 137/855 |
| 541721 | 12/1941 | United Kingdom | 137/855 |

*Primary Examiner*—John C. Fox

*Attorney, Agent, or Firm*—Darby & Darby

[57] ABSTRACT

A reed valve for a hermetic compressor having a case housing a cylinder and a piston movable therein with compression and suction chambers being defined in conjunction with the piston and an end plate provided with a refrigerating fluid passage hole defining with its outlet end a seat on which the flexible blade of a valve is seatable. The passage hole outlet end is in a spaced plane in relation to a parallel plane on the end plate to which the blade basic portion is attached with the blade, when not elastically deformed, lying in a sloped plane in relation to the plane containing the passage hole outlet.

12 Claims, 3 Drawing Sheets

REED VALVE FOR HERMETIC COMPRESSOR

BACKGROUND OF THE INVENTION

This invention refers to a hermetic compressor for small refrigerating machines and, more particularly, to a new constructive solution for a discharge and suction reed valve in a hermetic compressor of rotating type rolling piston type or reciprocating piston type.

The construction of a discharge system in hermetic compressors, especially in those of the rotary rolling piston type directly affects compressor energy and volume losses. One of the losses is the energy loss due to overpressure related to the readiness of opening the outlet valve after the pressure within the cylinder compression chamber has reached the discharge pressure. Another is a relatively poor efficiency of the discharge system, which once open, must operate as quickly as possible to evacuate the gas to be discharged.

In cases where the outlet valve does not adequately open, a condition of overpressure inside the cylinder compression will occur and the longer is the part of the compression cycle during said overpressure condition, the higher will be the effort and the power loss that the compressor crankshaft will have to overcome. As discussed above, it can be said that the careful definition of the constructive characteristics for the discharge system is a very important part when sizing a hermetic compressor.

The more usual solution adopted for the hermetic compressor discharge system, especially those of rotating rolling piston type, is a blade valve (or reed valve) whose stem is attached through screws or rivets to the plate in which the cylinder discharge hole is made.

A reed valve as above describes has some operating drawbacks causing energy losses in the compressor. Known reed valves have their stem attached by a rivet or screw in such way that the blade attachment is at the same level of its seat on the discharge hole. The known reed valves open at an angle (not parallel) to the seat, thus producing asymmetry in the discharge flow, making it inefficient. The above discussed operating characteristics for reed valves impair the gas discharge flow from the cylinder compression chamber thereby increasing the energy loss due to overpressure.

The above mentioned disadvantages concerning the known discharge valve in the form of a blade for rotary and reciprocating hermetic compressors can also be associated with suction valves in the form of reed valves for alternate hermetic compressors.

OBJECTS OF THE INVENTION

It is an object of the invention to provide a reed valve for a hermetic compressor, which is used in small refrigerating machines, which is able to minimize compressor energy losses due to the efficiency of the opening of the valve and of the gas passing said opening.

It is further an object of this invention to provide a reed valve of the above defined type which is easy to mount and has reasonable cost to manufacture.

BRIEF DESCRIPTION OF THE INVENTION

The reed valve of the invention is applicable to a hermetic compressor of the type including a case to house a cylinder defining compression and suction chambers in conjunction with a piston which is an eccentric on a rotating shaft. The compressor gas at least an end plate having at least a passage hole for the refrigerating fluid communicating with one of the chambers in the interior of the compressor housing. The valve comprises a flexible plate having a main portion thereof attached to the end plate face to which the outlet end of the passage hole opens and a sealing portion being movable between a position for closing the valve, seated on the outlet end of the passage hole, and a valve opening position away from the outlet end of the passage hole. The valve operates so that the movement of the sealing portion from one of its opening and closing positions to another said position is caused by elastic deformation of the blade by means of pressure differential between the interior of the cylinder chamber and the interior of the compressor housing.

According to this invention, the outlet end of the passage hole is provided on a plane spaced away in relation to the parallel plane containing the attaching point of the main plate portion. A portion of valve blade between the attaching plane of the main portion and the sealing portion is on a slanted plane so that the sealing portion intersects the outlet end plane of the passage hole in such a way that the sealing portion is seated at least on part on an outlet end edge of the passage hole which is diametrically opposed in relation to said plate attaching point. A valve seat is defined by the outlet end edge of the passage hole.

The structure of the invention makes it possible that the blade movement in the opening will occur in a way much more horizontal, that is, parallel to the passage hole seat in relation to what occurs in the prior art, where the blade is obliquely set on the seat after being open.

The increased parallelism is the opening of the blade results in a much more uniform and laminar gas flow and therefore the gas flowing characteristics are improved. Another advantage is that when there is no pressure differential and no elastic deformation of the valve blade and its sealing portion rests only on the edge of the outlet end of the passage hole, is that the blade opening will be caused more readily than when using the usual solution. The fact that the blade, when resting, is at least partially sloped in relation to the seat plane, allows a more facilitated and rapid break of the oil film which is formed against the valve seat under normal operation (such oil film causes the blade to "stick" on the seat).

Another fact contributing to the valve readily opening is that at its support on the valve seat, nearest the attaching end portion, the blade is less stressed (it even can be without any previous stress, having only the stress caused by the pressure differential to close in this side) than in the side of the sealing end portion. Therefore, valve opening can be made more easily in the attaching side when the inner pressure in the cylinder is substantially different from the pressure inside the housing.

Both effects, the refrigerating gas flow uniformity and the valve opening with more readiness, contributes to the reduction of energy loss by overpressure in the rotating compressors as well as in the reciprocating compressors and further causes the reciprocating hermetic compressor suction efficiency to be improved.

BRIEF DESCRIPTION OF THE DRAWINGS

The invention will be described with reference to the attached drawings, in which.

DETAILED DESCRIPTION OF THE INVENTION

Figure 1:
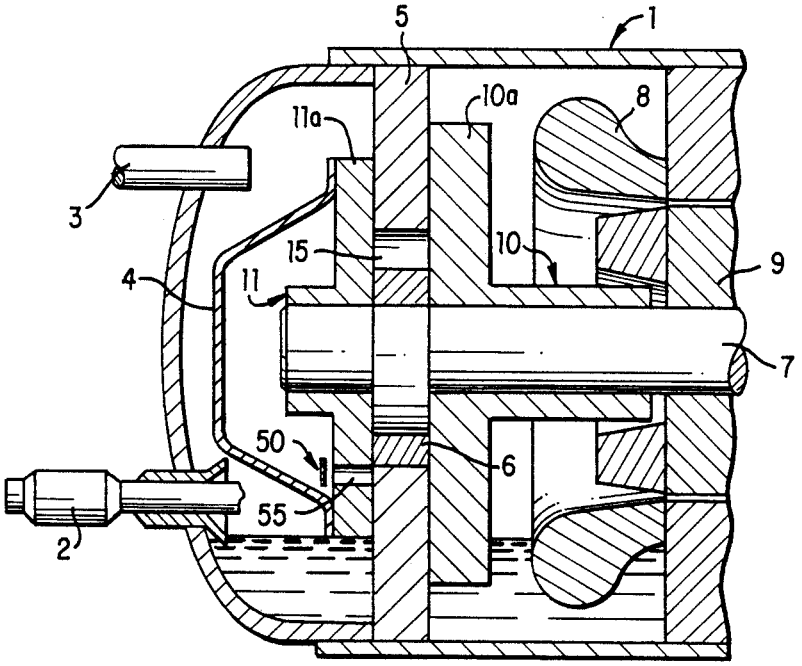
FIG. 1 shows a partial longitudinal section view of a rotating hermetic compressor including an outlet valve according to the invention.

As shown in FIG. 1, the compressor chosen to represent a preferred embodiment is a rotary hermetic compressor of the type comprising a case or housing 1 having an end portion to which are mounted a suction conduit and its coupling 2 and a discharge conduit 3. The case houses a cylinder assembly 5 and a rotating piston 6, the latter being an eccentric part mounted on a crankshaft 7 driven by an electric motor which has a stator 8 and rotor 9. The crankshaft 7 is supported by a main bearing 10 and a secondary bearing 11, each of them having a circular plate or flange 10*a* and 11*a* attached to the cylinder 5 outer axial faces. In the illustrated example a discharge damping chamber 4 is provided on the outer face of the secondary bearing 11 to receive the cylinder discharge volume gas 5 and pass the same into the inner environment of the housing 1.

Although not specifically illustrated, it should be understood that the cylinder 5 defines in conjunction with the rolling piston 6 and the plates 10*a* and 11*a* of the bearings 10 and 11, a suction chamber and a discharge chamber. The cylinder discharge chamber 15 is in fluid communication with the interior of the discharge dampening chamber 4 through an axial gas passage hole 55 which, in the illustrated embodiment, defines a gas discharge hole of the compressor assembly compression chamber.

Figure 2:
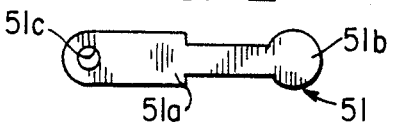
FIG. 2 shows a top plan view of the plate defining the reed valve.
Figure 3:
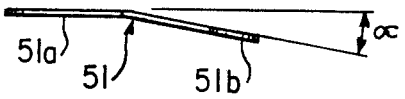
FIG. 3 shows a side view of the blade plate of FIG. 2, further showing the slope of the sealing portion in relation to the blade attaching main portion according to one configuration of this invention.

In the illustrated example, the reed valve 50 is used as a compressor assembly outlet valve for passage 55. As seen in FIGS. 2–4, the reed valve is formed by a flexible metal blade 51 having a main portion 51*a* and a sealing portion 51*b*. The basic portion 51*a* is attached to the secondary bearing end plate face 11*a* through which the passage hole outlet end 55 is open. The attachment of the blade 50 is made by a fastener such as a screw or rivet 53 extending through a corresponding hole 51*c* in the basic portion 51*a*. The fastener 53 also attaches to the blade 51 basic portion 51*a* a backstop 56 (see FIG. 4) in the form of a stiff plate which extends over the area above the passage hole 55.

In the illustrated embodiment of the invention, the passage hole 55 has its outlet end located in a plane which is spaced away from the plane of the point of attachment of the blade 51 basic portion 51*a* to the face of bearing 11*a*. Further, the passage hole outlet end 55 is located within a recess 58 in the end plate face 11*a*. A raised reed valve seat surround opening 55.

In the illustrated embodiment, the basic portion attaching plane 51*a* of the blade 51 is parallel to but spaced away from the valve seat plane of the passage hole outlet end 55. The backstop 56 is also provided in a plane parallel to the first two planes and adjacent to and above the blade 51 basic portion 51*a*.

Figure 4A:
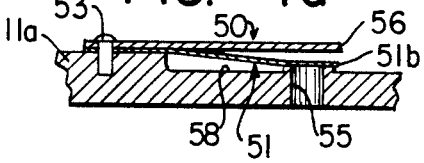
FIGS. 4*a*, 4*b*, 4*c* and 4*d* are enlarged section views of FIG. 1 wherein the rotating hermetic compressor reed valve is located, with the figures showing the reed valve in its full closing position of the passage hole; partial closing of the passage hole when any plate elastic deformation does not exist; the reed valve being slightly away from the passage hole outlet end in a mean opening; and a fully open valve position shown in FIG. 4*d*.
Figure 4B:
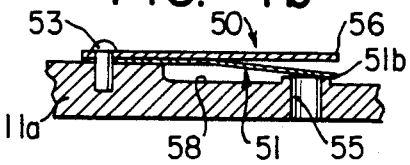

As seen in FIGS. 3 and 4*b*, the blade 51 is bent to cause its sealing portion 51*b* to be placed in a sloped plane in relation to the basic portion 51*a* and the plane containing the passage hole outlet end 55. The spacing between the basic portion attaching plane 51*a* and the passage hole outlet end plane 55 and the sloping angle of the sealing portion 51*b* in relation to the basic portion 51*a* are sized such so that in a condition where the blade 51 has not any elastic deformation caused by pressure differential between the compression chamber and the housing interior 1, the sealing portion 51*b* is only seated on a part of the outlet end edge of the seat surrounding passage hole 55 which is diametrically opposed in relation to the basic portion 51*a* attaching point 53 of the end plate 11*a*. This is shown in FIG. 4*b*.

With the above described arrangement, the blade 51 is slightly open in relation to the valve seat when the pressures in the two opposed sides of the passage hole 55 are balanced. The balanced condition occurs when the piston finishes a suction cycle without having yet started the compression cycle. This configuration allows the sealing portion 51*b* to start the "unglueing" (lifting from the valve seat) before the refrigerating fluid load compressed inside the cylinder reaches the final pressure for the full valve opening. At that time the plate 51 is elastically deformed so as to seat against the backstop adjacent face 56, see FIG. 4*d*, and will be in a plane parallel to and spaced away from the plane containing the passage hole 55 outlet end, thereby resulting in the advantages discussed above.

Figure 4C:
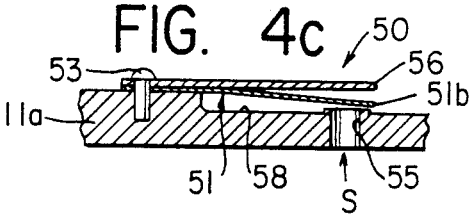
Figure 4D:
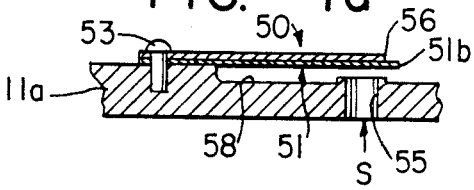

As seen in FIGS. 4*a* to 4*d*, during the piston suction cycle 6, the compression chamber inner pressure becomes negative in relation to the pressure existing in the end plate 11*a* inner side where the blade 51 is located, causing the sealing portion 51*b* of the latter to be elastically deformed so as to fully seat on the passage hole outlet end 55, thereby causing the valve closing 50, as illustrated in FIG. 4*a*. As the piston 6 moves inside the cylinder 5, the pressure inside the compression chamber reaches a value which balances with the pressure value inside the case 1 of the compressor, causing the blade 51 to have its original conformation not elastically deformed being illustrated in FIG. 3. In this condition, as illustrated in FIG. 4*b*, its sealing portion 51*b* will only seat partially on the passage hole outlet end 55. At other than the negative pressure or balanced condition there is started an "unglueing" of said blade 51 in relation to the valve seat, such as illustrated in FIG. 4*d*. As the piston 6 moves inside the cylinder 6, a given pressure value for the refrigerating fluid inside the latter is produced and the blade 51 will be elastically deformed, starting the valve opening. There will be a progressive spacing in relation to the passage hole outlet end 55 until the valve fully seats against the backstop adjacent face 56, such as illustrated in FIGS. 4*c* and 4*d*.

In FIGS. 4*c* and 4*d*, the arrows S indicate the refrigerating fluid passage direction through the discharge hole 55, since the valve represented in said figures would correspond to the outlet valve which is usable in a rotary or reciprocating type compressor. However, it will be noted that the valve illustrated in FIGS. 4*a* and 4*d* can also be applied as a suction valve to a reciprocating piston type compressor. In this case, the blade 51 and the backstop 56 would be located on the end plate face 11*a* faced to the interior of the suction chamber and the assembly would function in the same manner as described in relation to the use of said valve as an outlet valve.

In the case of rotating piston hermetic compressors, such as that illustrated in FIG. 1, the end plate 11*a* is defined by the secondary bearing itself for supporting the shaft, while in the alternate piston type compressors the end plate 11*a* is defined by the valve plate sealing the open end in the compressor cylinder block.

Figure 5:
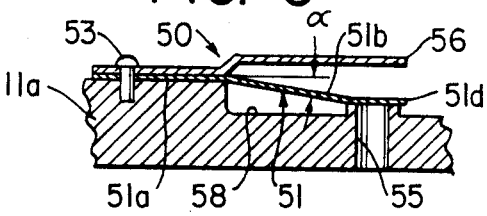
FIG. 5 is a view similar to that in FIGS. 4*a* and 4*b*, illustrating another possible configuration for the blade when in a full closing position of the passage hole having or not an elastic deformation force applied on the blade.

FIG. 5 shows another embodiment for the reed valve 50 which has its metal blade 51 provided with a basic portion 51*a* and a sealing portion 51*b*. The attachment of the blade to the compressor is effected such as described in relation to the embodiment of FIGS. 4*a*, 4*b*, 4*c* and 4*d*.

In this embodiment, the blade 51, has in addition to the plate medial bent position folding shown in FIGS. 4*a* and 4*d* a further bent end portion 51*d* such as to cause the sealing portion 51*b* to fully seat on the passage hole outlet end edge 55 when the blade is in a condition free from any elastic deformation due to pressure differential between the compression chamber and the case interior 1.

Although only two embodiments for the invention have been described and illustrated, it should be understood that modifications can be made without departing from the inventive concept contained in the claims. For instance, the blade 51 basic portion 51*a* and the adjacent portion for attaching the backstop 56 need not necessarily be in a plane parallel to the plane containing the passage hole outlet end 55. It is sufficient that the backstop portion adjacent to the blade sealing portion 51*d* is located in a plane parallel to that for the passage hole outlet end 55 and at least a part of the sealing portion 51*b* when not elastically deformed is in a sloped plane at a somewhat greater angle to the edge of said passage hole outlet end 55. In this case, the plate 51 could have the main portion 51*a* thereof and sealing portion 51*b* provided in the same sloped plane in relation to the passage hole outlet end 55.

I claim:

1. A compressor having a housing, a cylinder within said housing;

a piston for moving within said cylinder, means for defining with said cylinder a suction chamber and a compression chamber, said defining means including a plate with a through passage in a fluid communication with one of said chambers, said passage having an outlet in a first plane at one face of the plate, a blade valve having one end for sealing said outlet, said blade valve being elastically deformable in response to the pressure differential between the chamber with which the passage communicates and the interior of the housing;

means for attaching the other end of said blade in a second plane spaced from said first plane, at least a portion of the blade between said ends being at an angle between the two planes to place the one end of the blade in sealing relationship to at least the edge of the passage outlet which is furthest from the blade other end when there is no pressure differential, between the communicating chamber and the inside of the housing.

2. The combination of claim 1 further comprising stop means attached to said plate in a plane spaced from said first plane and parallel to and above said second plane, said blade when the valve is in the fully open position engaging said stop means.

3. The combination of claim 1 wherein the portion of the blade at an angle extends to said blade one end.

4. The combination of claim 3 wherein the blade has a second bent section on the sealing portion so that said second bent section is fully seated to close the outlet of the passageway when there is substantially no pressure differential between the communicating chamber and the interior of the housing.

5. The combination according to claim 4, wherein the end portion of the sealing portion is parallel to said parallel plane containing the basic portion attaching point.

6. The combination of claim 1 wherein the blade has a second bent section on the sealing portion so that said second bent section is fully seated to close the outlet of the passageway when there is substantially no pressure differential between the communicating chamber and the interior of the housing.

7. The combination according to claim 6, wherein the end portion of the sealing portion is parallel to said parallel plane containing the basic portion attaching point.

8. The combination according to claim 1, wherein in the valve closing position, the pressure differential seats the blade sealing portion on the passage hole edge.

9. The combination according to claim 1, wherein the passage hole is the discharge hole of the compression chamber.

10. The combination according to claim 1, wherein the passage hole is the reciprocating type compressor suction hole.

11. The combination according to claim 1, wherein the passage hole outlet is located on the bottom of a recess in a face of said plate.

12. The combination of claim 11 further comprising a valve seat surrounding the opening of the outlet of said passage.

* * * * *

PRINTER'S TRIM LINE

UNITED STATES PATENT AND TRADEMARK OFFICE

CERTIFICATE OF CORRECTION

PATENT NO. : 4,978,285

DATED : December 18, 1990

INVENTOR(S) : Caio Mario F. N. Da Costa

It is certified that error appears in the above—identified patent and that said Letters Patent is hereby corrected as shown below:

ON THE TITLE PAGE, Item [73]

Please correct the Assignee's name from "Empresa Brasileira de Compressores S.A." to --Empresa Brasileira de Compressores S.A. - EMBRACO--.

Signed and Sealed this

Twelfth Day of January, 1993

*Attest:*

DOUGLAS B. COMER

*Attesting Officer*

*Acting Commissioner of Patents and Trademarks*